US011207797B2

(12) United States Patent
Heinrich

(10) Patent No.: US 11,207,797 B2
(45) Date of Patent: Dec. 28, 2021

(54) MASONRY TOOL

(71) Applicant: Gordon Heinrich, Narvon, PA (US)

(72) Inventor: Gordon Heinrich, Narvon, PA (US)

( * ) Notice: Subject to any disclaimer, the term of this patent is extended or adjusted under 35 U.S.C. 154(b) by 123 days.

(21) Appl. No.: 16/513,898

(22) Filed: Jul. 17, 2019

(65) Prior Publication Data

US 2020/0023552 A1 Jan. 23, 2020

Related U.S. Application Data

(60) Provisional application No. 62/699,129, filed on Jul. 17, 2018.

(51) Int. Cl.
*B28D 1/22* (2006.01)
*B25D 1/00* (2006.01)

(52) U.S. Cl.
CPC ..... *B28D 1/225* (2013.01); *B28D 1/228* (2013.01); *B25D 1/00* (2013.01)

(58) Field of Classification Search
CPC ..... B28D 1/225; B28D 1/228; B28D 1/223; B28D 1/26; B28D 1/265; B28D 7/04; B28D 7/043; B25D 2217/0015; B25D 2222/72; B25B 33/00
See application file for complete search history.

(56) References Cited

U.S. PATENT DOCUMENTS 1,479,291 A * 1/1924 Evans ..... E04H 17/10 256/57
3,978,842 A * 9/1976 Coffman ..... B28D 1/223 125/23.01
5,860,636 A * 1/1999 Duncan ..... E04H 17/161 256/1
D621,249 S * 8/2010 Heindl ..... D8/382
8,943,691 B2 * 2/2015 Olsson ..... B21H 7/00 29/890.148
D886,560 S * 6/2020 Heinrich ..... D8/47
2011/0308197 A1 * 12/2011 Wallace ..... E04C 3/32 52/846

OTHER PUBLICATIONS

Nsvistone, The "King Cutter"—Promotional Video, Jan. 19, 2016, YouTube, available at https://www.youtube.com/watch?v=NfTgOJedLq0&list=PLP8_ivm6vsauRYpNapvEjJ5tbmodVkzcY&index=5 (Year: 2016).*
Trowandholden, Thin Stone Veneer Set, Nov. 6, 2015, YouTube, available at https://www.youtube.com/watch?v=fcT_ZNJfsYA (Year: 2015).*

* cited by examiner

*Primary Examiner* — Michael McCullough
(74) *Attorney, Agent, or Firm* — Steve O'Donnell

(57) ABSTRACT

An apparatus for trimming stone and brick is disclosed. The apparatus is comprised of flat sections which radiate from a central axis. Each of the flat sections has two cutting edges, for a total six cutting edges.
In use, the apparatus is placed onto a supportive platform so two of the flat sections contact the platform, while the third extends up and is an apical striking platform. The mason holds a stone or brick so it rests on one of the cutting edges of the apical striking platform and strikes the top face of the stone or brick with a hammer, approximately over where the stone or brick contacts the edge of the trimmer.
In addition to providing a cutting surface, the subject matter of this application reduces errant vibration caused by the striking which can result in irregular cutting.

2 Claims, 4 Drawing Sheets

Vibration Study

| Test condition | Hammer Acceleration (g) | Total Acceleration of Brick (g) | Total Acceleration of Brick/Hammer Acceleration |
|---|---|---|---|
| Free hand | 1604 | 970 | 0.6047 |
| I-Beam | 1662 | 1014 | 0.6101 |
| King Cutter | 1477 | 1019 | 0.6899 |
| Subject matter of this application | 1676 | 1001 | 0.5973 |

Standard red bricks were used for all tests. Results for each test condition were averaged over several bricks. Two accelerometers were placed on each brick prior to being struck. The location of the accelerometers was roughly equal for all bricks tested.

Figure 4

MASONRY TOOL

FIELD OF THE INVENTION

The subject matter of this application pertains to methods for and devices for trimming natural and manufactured stone and bricks. More particularly, the subject matter of this application pertains to method and devices for trimming natural and manufactured stone and bricks that reduce the vibrations that move through the stone or brick when struck and which can cause unintended breaks and cracks along naturally occurring veins in a rock or along the hairline cracks that may develop while curing manufactured stone and brick.

BACKGROUND

Masons need to trim and shape materials such as stone, brick, and natural or manufactured stone veneers. There are several methods of trimming and shaping these materials, not all of which are suited for use by a mason at a job site, especially not if that mason is standing on scaffolding.

The simplest method of trimming the materials is nothing more than giving it a good whack with a hammer, although at a minimum most would at least place the material over a ridge and hope the material cleanly breaks over that ridge. Several items can be used provide this ridge such as other stones, the edge of scaffolding, sections of I-beams, or really any other item with an edged surface.

Obviously these ridged or edged platforms need to be able to withstand the force of a rock being broken over it and be stable enough not to shift when struck at an angle. An easily crushed platform is useless in this context and a platform that shifts when struck can harm not only the stone, but also the user and whatever structure the platform is on. To mitigate the problems of a shifting platform many of the commonly used items are intended to be bolted into place. Although bolting such an item in place may eliminate the risks associated with a shifting platform, it also forces the mason to carry the materials to the bolted apparatus, whack them, then walk back to where the stone needs to be placed. It also requires the mason to move the bolted apparatus if needed somewhere else. This excess work increases the amount of time a job takes to complete and forces the mason to do less productive work per hour increasing costs and decreasing income. It would be more efficient if such a platform could be easily moved to wherever it was needed and somehow maintain stability without having to be bolted or otherwise secured before use.

There are other problems also associated with simply holding a rock or brick against a platform and whacking it with a hammer. One problem is that striking the targeted rock or brick can cause said rock or brick to undergo acceleration-associated stress which can in turn cause the rock or brick to break in difficult to predict patterns causes by naturally occurring faults or hairline cracks created during the curing or culturing process. Ideally, a stone trimming platform would also reduce the acceleration of the targeted stone or brick when struck.

SUMMARY

The primary objective of the subject matter of this application is to provide an apparatus which provides an edge or ridge for use with cutting stone and brick materials. A further objective is to provide an apparatus with several suitable edges or ridges such that the need to hone or sharpen and edge is minimized. Also, a further objective is to provide an apparatus that resists movement when force is applied at an angle to the top of the apparatus. Yet another objective it to provide such an apparatus which reduces the acceleration of the targeted stone or brick when struck.

Disclosed herein in a novel device for trimming stone. The trimmer has three planes of metal extending from the center of the trimmer. Each plane has a first face, a second face, and a terminal face. The intersection of the first or second face with the terminal face forms an edge. In this manner, the trimmer has six edges (two per plane) for use with stone trimming. Further the two planes not in use function as legs to stabilize the trimmer on a surface and the edges of those faces dig into surfaces such as wood to help stabilize the trimmer and resist movement when the force is applied to the other plane.

BRIEF DESCRIPTION OF THE DRAWINGS

FIG. 4 is a data table from a series of tests on brick vibration following a hammer strike.

DETAILED DESCRIPTION OF THE INVENTION

Figure 1:
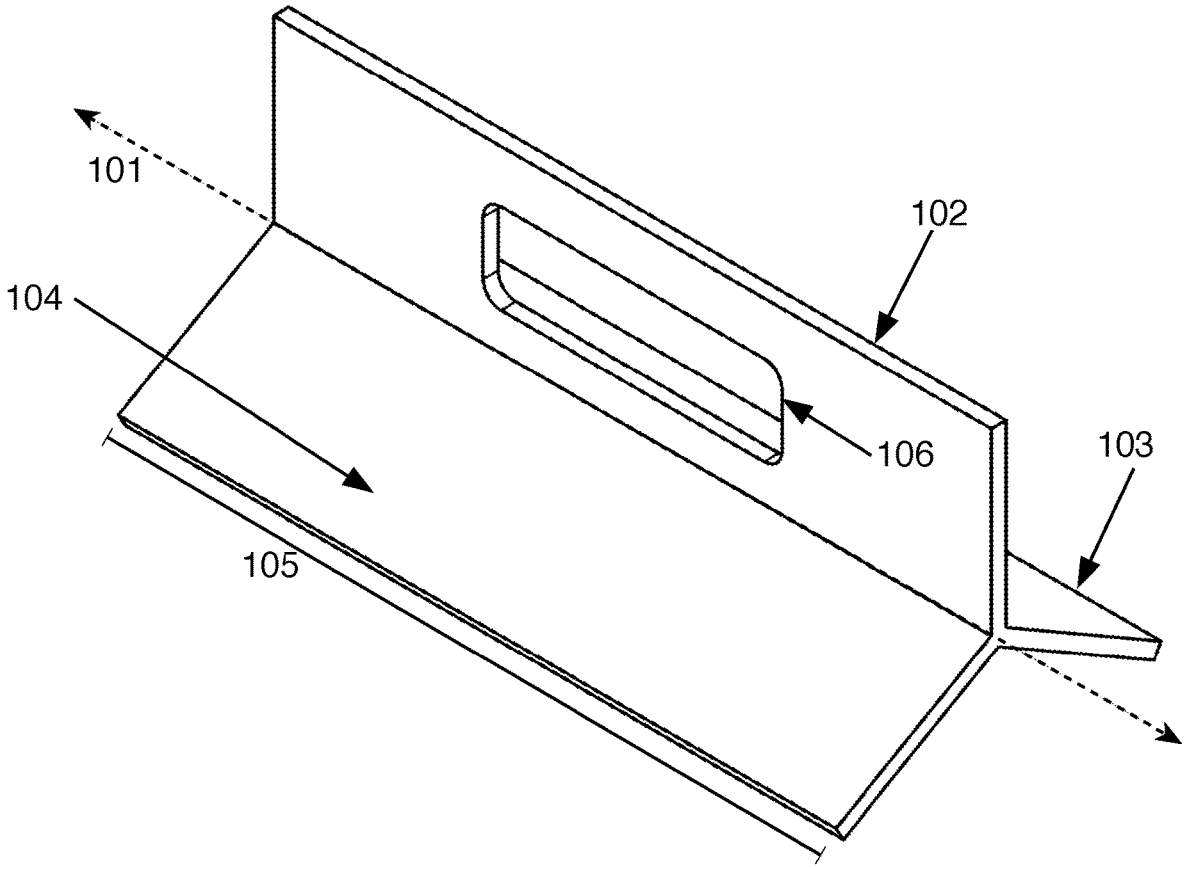
FIG. 1 is a perspective view of the disclosed trimmer.

The following description and referenced drawings illustrate embodiments of the application's subject matter. They are not intended to limit the scope. Those familiar with the art will recognize that other embodiments of the disclosed method are possible. All such alternative embodiments should be considered within the scope of the application's claims.

For brevity, as used below, "stone" includes natural and manufactured stones and veneers as well as bricks and other items having similar properties.

Each reference number consists of three digits. The first digit corresponds to the number of the figure in which that reference number is first shown. Reference numbers are not necessarily discussed in the order of their appearance in the figures.

The trimmer has a central longitudinal axis (101) defining a center (203), a first plane (102), a second plane (103), and a third plane (104). Each said plane further comprises a width (e.g., 105), a depth (e.g., 201), and height (e.g., 202). Each said plane also comprises a first face (e.g., 204), a second face (e.g., 205), and a terminal face (e.g., 206). The intersection of a first face of a plane and the terminal face of the same plane forms a first edge (207). The intersection of a second face of a plane and the terminal face of the same plane forms a second edge (208).

In a most preferred embodiment, each plane is made of the same material, and the width, depth, height, and shape of each said plane is substantially identical. Accordingly, in an attempt to increase readability of the specification by eliminating repetition, descriptions of one plane should be understood to apply to all planes unless otherwise specified.

Figure 2:
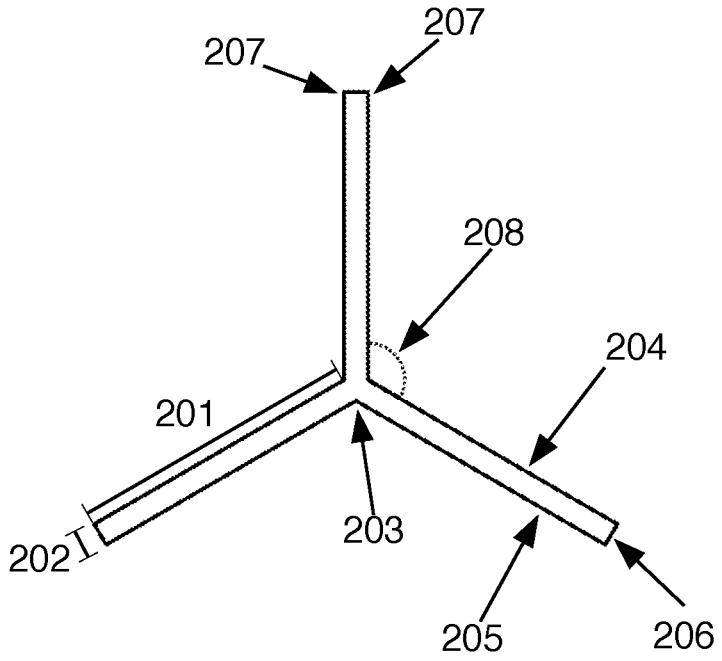
FIG. 2 is a side view of the disclosed trimmer.
Figure 3:
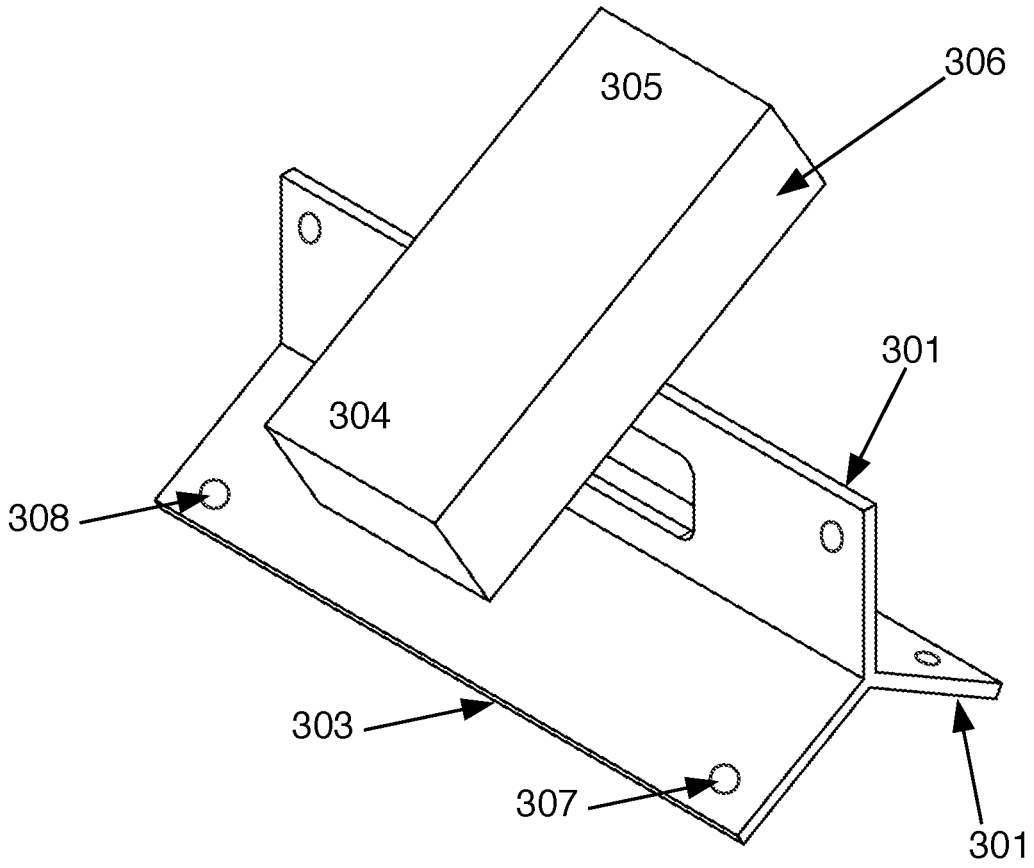
FIG. 3 is another illustration of the disclosed trimmer with a brick in place to be struck.

As viewed from the side as shown in FIG. 2, the center of the trimmer is a vertex and each plane is a line segment radiating from said vertex. The angle (208) formed by any two adjacent planes is approximately 120°.

In preferred embodiments at least one plane of the trimmer comprises a carrying gap (106) to make carrying the trimmer easier and more comfortable. A rope or chain can be passed through such a gap and secured to scaffolding or other surface so that an accidental bump doesn't cause the trimmer to fall, potentially injuring people or property.

In use, the trimmer is placed on a (preferably wooden) surface so that there is an apical plane (301), a first leg plane (302), and a second leg plane (303). One edge of each of the leg planes contacts the surface, so the edges contacting the surface can dig into the surface and in that way be stabilized. Wood is preferred for the surface because it will slightly yield to the force delivered to it when the trimmer is struck, stabilizing said trimmer, and because wood will not significantly dull or displace an edge of the trimmer. Some preferred embodiments further comprise two or more holes (e.g., 307 and 308) on each plane in which a nail or screw could be used to secure the trimmer to the surface, further increasing stability and decreasing the risk of the trimmer falling and injuring someone or something. A stone (306) having a distal (304) and proximal (305) portion is placed over the first or second edge of the apical plane and is struck from above. Typically the mason would hold onto the proximal portion of the stone at a downward angle so that the path of the desired break is in line with where the stone contacts the trimmer. A sufficient hammer blow to the top of the stone, directly opposite where the stone contacts the trimmer causes the stone to break, ideally in a roughly straight line, parallel to where the stone contacts the trimmer. The distal portion of the stone is that which is cut away to leave the useable final stone. The trimmer may be rotated so each of the six edges of the trimmer wear somewhat evenly or a single edge may be used until it is deformed and a fresher edge is chosen.

The degree in which a brick vibrates after being struck was studied by attaching two accelerometers the brick, steadying the brick, and striking the brick with a masonry hammer also equipped with an accelerometer. There were four test conditions: 1) free hand, 2) I-beam, 3) King Cutter (a product of Natural Stone Veneers International, Inc.), and 4) the subject matter of this application. In the free hand test group, the tester held a brick in one hand while it was struck by a masonry hammer welded in the other. In the other test conditions, the brick was steadied against either a section of I-beam, a King Cutter, or the subject matter of this application, and struck with a masonry hammer. The acceleration measured on the brick after being struck correlates with how much the brick vibrated in response to being struck. The lower the ratio is between the total acceleration of the brick and the acceleration of the hammer, the less energy is spread across the entirety of the brick and the more energy is directed through the brick in the direction followed by the hammer. Use of the subject matter of this application resulted in the lowest combined brick acceleration to hammer acceleration ration, which was associated with observed straighter or "cleaner" cuts associated with the subject matter of this application.

I claim:

1. A method for trimming stone using an apparatus, said apparatus comprising a central longitudinal axis, a first plane, a second plane, and a third plane, said first plane comprising a width, a depth, a height, a first face, a second face, and a terminal face, said second plane comprising a width, a depth, a height, a first face, a second face, and a terminal face, said third plane comprising a width, a depth, a height, a first face, a second face, and a terminal face, said first plane and second plane forming a first angle having a vertex at the central longitudinal axis, said second plane and third plane forming a second angle having a vertex at the central longitudinal axis, said third plane and first plane forming a third angle having a vertex at the central longitudinal axis, and the sum of the first angle, the second angle, and the third angle is 360 degrees, said method comprising the steps of placing the apparatus on a stable surface such that the first and second of the said planes are in contact with the stable surface and the third plane is approximately perpendicular to the stable surface, holding a stone against the terminal face of the third plane, and striking the stone with an implement directly over the terminal face of the third plane with sufficient force to fracture the stone.

2. The method of claim 1 in which striking a stone at a given acceleration of the implement causes the stone to accelerate at no more than 0.60 the value of the implement acceleration.

* * * * *